United States Patent [19]

Nelson

[11] Patent Number: 4,497,137

[45] Date of Patent: Feb. 5, 1985

[54] WEATHER STRIP

[75] Inventor: Jon N. Nelson, Golden, Colo.

[73] Assignee: Energy Conservation Associates Incorporated, East Lyme, Conn.

[21] Appl. No.: 432,802

[22] Filed: Oct. 5, 1982

[51] Int. Cl.[3] ..... E06B 7/16

[52] U.S. Cl. ..... 49/496; 49/485; 49/495

[58] Field of Search ..... 49/496, 475, 495, 485

[56] References Cited

U.S. PATENT DOCUMENTS

| | | | |
|---|---|---|---|
| 2,249,424 | 7/1941 | Hanington | 49/475 X |
| 3,360,888 | 1/1968 | Protzman | 49/496 |
| 4,084,348 | 4/1978 | Hast | 49/475 |
| 4,112,623 | 9/1978 | McPherson | 49/495 X |

FOREIGN PATENT DOCUMENTS

| | | | |
|---|---|---|---|
| 355473 | 8/1931 | United Kingdom | 49/475 |
| 1258563 | 12/1971 | United Kingdom | 49/475 |

*Primary Examiner*—Philip C. Kannan
*Attorney, Agent, or Firm*—Hayes & Reinsmith

[57] ABSTRACT

A composite weather strip is disclosed having a semi-rigid elongated body and a relatively flexible extension formed in integral coplanar relation on a side edge of the body. The extension is laterally tapered to a feathered edge and has longitudinal ribs projecting from one surface of the extension. A foam tape attaches the body to one of two relatively movable surfaces, such as a frame surface and an adjoining surface of a window or door, adjacent a joint between the two surfaces. Whenever the window or door is closed, the flexible extension is engaged with the other of the two surfaces and, upon such engagement, is deflected to provide a positive seal against the passage of air through the joint in a sealing construction of exceptionally high integrity.

4 Claims, 4 Drawing Figures

WEATHER STRIP

FIELD OF THE INVENTION

This invention generally relates to weather stripping and more particularly concerns weather strips for providing an airtight seal between relatively movable door or window members while permitting those units to remain functionally unimpaired.

BACKGROUND OF THE INVENTION

Increased demand for energy saving techniques has resulted in a variety of products to prevent air leaks past adjoining surfaces of windows or doors in an effort to minimize undesired heat transfer. A plethora of devices have appeared utilizing a host of different techniques ranging from plain plastic tape, felt strips, self-sticking plastic clad vinyl and foam tapes and a variety of seals of special and sometimes expensive construction which are installed in a variety of ways. The following U.S. patents additionally provide different examples of efforts to seal adjoining relatively movable surfaces against the passage of air:

U.S. Pat. No. 2,249,424, Hanington
U.S. Pat. No. 3,360,888, Protzman
U.S. Pat. No. 3,380,582, Moyer, Jr., et al
U.S. Pat. No. 3,581,884, Caldwell et al
U.S. Pat. No. 3,883,993, Pullan
U.S. Pat. No. 4,126,966, Lobell
U.S. Pat. No. 4,302,262, Kay.

Known conventional techniques for preventing drafts about doors, windows, hatchways and other openings such as about air conditioners, clearly suggest a need for providing an inexpensive, attractive weather strip quick and easy to manufacture and install in a relatively unnoticeable position on either interior or exterior surfaces without impairing the function of the units to be sealed and which, if desired, may be maintained in installed position on a permanent, virtually service-free basis while providing a seal of high integrity.

SUMMARY OF THE INVENTION

In accordance with this invention, a quality weather strip of exceptional attractiveness and durability is disclosed which is particularly suited for low cost manufacture and facile installation to provide a highly efficient seal against undesired passage of air between two relatively movable surfaces. An elongated composite resilient plastic strip is formed with a semi-rigid body if rectilinear cross-section and an extension integrally formed along a side edge of the body, the extension being of reduced lateral dimension relative to the width of the body. The extension is intentionally and precisely tapered from its juncture with the side edge of the body to a feathered tip. The extension as a whole is significantly more flexible than that of the body and serves as a sealing member of variable pliancy featuring a gradually increasing flexibility laterally across the extension toward its tip. A double-faced adhesive foam tape is secured to extend longitudinally along one surface of the body. One surface of the extension is striated with spaced projecting ribs which extend longitudinally of the extension in parallel relation to its juncture with the body.

Other objects will be in part obvious and in part pointed out in more detail hereinafter.

Better understanding of the objects, advantages, features, properties and relations of this invention will be obtained from the following detailed description and accompanying drawing which set forth certain illustrative embodiment and are indicative of the various ways in which the principle of this invention is employed.

DESCRIPTION OF PREFERRED EMBODIMENTS

Figure 1:
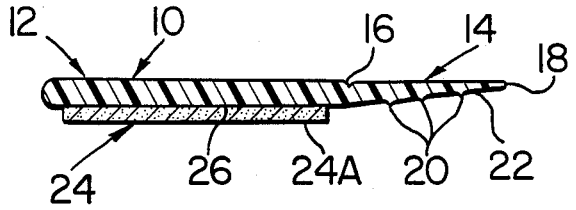
FIG. 1 is a cross-sectional view of a weather strip incorporating this invention.
Figure 2:
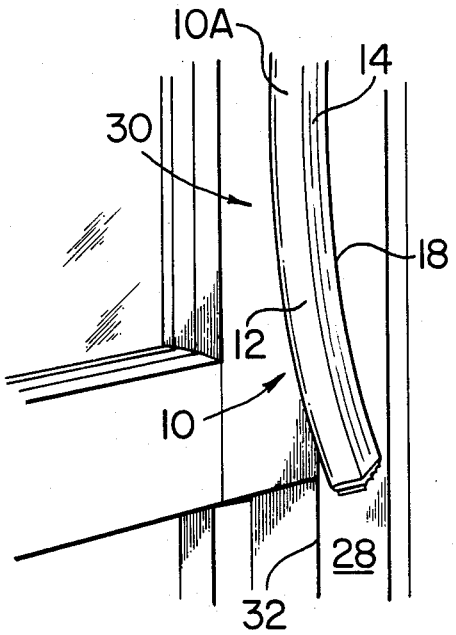
FIG. 2 is an isometric view of a typical installation utilizing the weather strip of FIG. 1.
Figure 3:
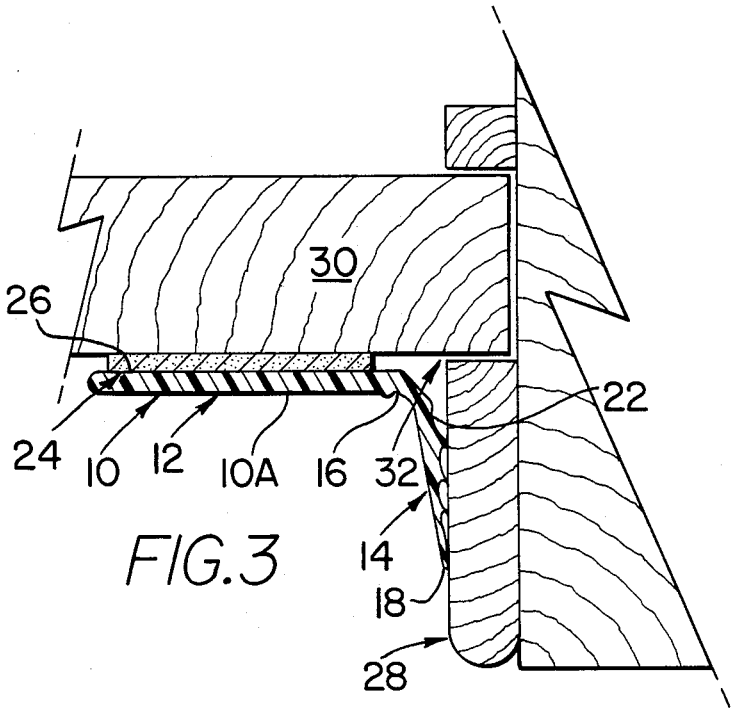
FIG. 3 is a cross-sectional view of the weather strip of FIG. 1 in installed position.

Turning now to the drawing in detail, a composite weather strip 10 is illustrated in FIGS. 1–3 wherein it is to be understood that the strip 10 is formed in a co-extrusion process utilizing polyvinyl chloride (PVC) or an equivalent material. A PVC compound marketed by B. F. Goodrich Chemical Company as "Geon" vinyl has been found to perform satisfactorily. Resistance to discoloration from ultraviolet rays and extreme heat and cold are characteristic of the weather strip material in addition to providing resiliency, durability and the capability of being formed in an integral manner with portions of the resulting extruded strip 10 having significantly varying characteristics of relative stiffness and relative flexibility.

For most typical installations having a variety of different doors and windows, it has been found that a relatively rigid elongated flat attachment body 12 of generally rectilinear cross section may be provided in widths, say, of $\frac{5}{8}$ inch, $\frac{7}{8}$ inch and $1\frac{3}{8}$ inch. For each of the described body widths, a relatively flexible extension 14 is formed in integral, generally coplanar relation of the body 12 along its side edge and having lateral dimensions, respectively, of $\frac{1}{4}$ inch, $\frac{3}{8}$ inch and $\frac{5}{8}$ inch corresponding to the described body widths.

To provide a seal of increased integrity for a variety of different sealing applications, the flexible extension 14 features a cross-section which is generally uniformly tapered from its juncture along one side edge 16 of the body 12 toward a free terminal edge or feathered tip 18. The extension 14 accordingly is intentionally and precisely formed to exhibit a variable pliancy which gradually increases in flexibility laterally of the extension 14 toward its tip 18. While PVC is a relatively rigid extrusion compound, it has been found that an elastomer may be added to the PVC in the co-extrusion process in the formation of extension 14 which, when coupled with the reduced thickness of the tapering extension 14, provides an added flexibility relative to that of the body 12. The body 12 may be formed to exhibit a durometer hardness of about $82\pm3$, whereby the desired characteristics of strip 10 as fully explained below are obtained while yet ensuring a relatively stiff strip for ensuring ease of installation. More specifically, in one series of tests per American Society of Testing and Materials (ASTM) D-638, body 12 was found to exhibit a tensile strength of 6,200 psi and a tensile modulus of 355,000 psi; the flexural strength of body 12 was 11,300 and the flexural modulus was found to be 410,000 psi per ASTM D-790 test method.

To accommodate irregularities in surfaces adjoining a joint to be sealed and prevent unintended sticking in an installed position while providing further structural strength and added resistance to undesired deformation normal to a longitudinally extending flex axis in the precisely formed extension 14, a plurality of ribs 20 are formed to project from surface 22 of the disclosed extension 14.

To additionally accommodate troublesome surface irregularities without compromising the desired ease of installation. the body 12 of strip 10 is provided with cushioning means which comprises a vinyl foam tape 24 having a coat of adhesive respectively applied to each of its opposite faces. In the illustrated embodiment, tape 24 is shown applied to surface 26 of body 12. If desired and depending on the particular application, it will be understood that tape 24 may be applied to body 10 on its surface opposite surface 26. A double coated vinyl foam tape specified as "IM 2750 Mac-Tac" made by Morgan Tape Company has been found to perform satisfactorily. Tape 24 is provided with a removable protective cover, not shown, which may be readily stripped prior to installation to expose a tacky outer adhesive surface 24A of tape 24 which extends longitudinally along body 12. A $\frac{1}{2}$ inch wide tape has been used and found to be suitable for a $\frac{5}{8}$ inch wide body; a $\frac{3}{4}$ inch tape and 1 inch tape have been satisfactorily used, respectively, with body widths of $\frac{7}{8}$ inch and $1\frac{3}{8}$ inch. Tape 24 accordingly assures an effective cushioning bond of strip 10 to an irregular surface.

As seen in FIG. 1, the composite plastic strip 10 is of uniform cross section throughout its length which may be made to any convenient desired dimension and later may be readily cut with any suitable tool to custom lengths upon installation. During installation, an attractive seal is effected by weather strip 10 of this invention upon simply cutting strip 10 to length, stripping the protective cover from outer adhesive face 24A of tape 24 and then pressing strip body 12 into position on one of two movable surfaces 28 and 30. Such action affixes strip 10 by means of its tape 24 to that one surface with the juncture 16 (between the body 12 and its flexible extension 14) being in adjacent parallel relation to joint 32 between the two relatively movable surfaces 28, 30 adjoining the joint to be sealed. In FIGS. 2 and 3, the relatively movable surfaces are depicted as a fixed frame 28 and a sash 30 of a double hung window. In FIG. 2, the relatively rigid attachment body 12 is shown partially installed in fixed relation to sash 30, strip 10 being in a completely installed position in FIG. 3. Upon engagement of flexible extension 14 with frame 28, ribbed face 22 of extension 14 is deflected along its flex axis, which extends parallel to joint 32, into installed position (FIG. 3) wherein strip extension 14 is shown assuming an arcuately configured cross-section with ribs 20 providing line contact engagement of strip 10 to surface 28. The disclosed tapered and ribbed features of deflectable extension 14 have been found to provide an effective sealing force applied by the extension 14, particularly adjacent its fixed body 12 which in turn provides an exceptionally good seal with an engaged surface in cooperation with its cushioned tape 24, despite surface irregularities, under a variety of extreme ambient conditions. Significantly effective resistance to the passage of air through the joint of the sealed surfaces is accordingly effected by disclosed strip 10. More specifically, in accordance with tests performed per ASTM E 283-73 the following data was observed on old wood frame casement windows, wherein the "sealed" condition utilized strip 10 of this invention:

| | TEST PRESSURE | WIND VELOCITY | ACTUAL LEAKAGE RATE |
|---|---|---|---|
| Unsealed | 1.56 psf | 25 mph | 5.75 cfm/foot of sash |
| Sealed | 1.56 psf | 25 mph | 0.85 cfm/foot of sash |

The strip 10 of this invention has been found to perform satisfactorily under rigorous wear testing for door closures and sliding along wood surfaces. It is to be noted that the function of the closures such as double-hung, slider and casement type windows, doors, hatchways and the like is totally unimpaired, each such closure is free to be moved between opened and closed positions with the weather strip 10 installed in non-interfering relation to the frame and the closure at all times.

By virtue of the double-faced adhesive tape 24, no unsightly fasteners or holes mar the appearance of an exposed "dress" face 10A of the strip 10. The strip 10 will be understood to be suited for both interior and exterior applications and exhibits resistance to ultra-violet rays while insuring an excellent adhesive bond to wood, metal and vinyl with good peel resistance under room conditions as well as under extreme temperature variations therefrom. The polyvinyl chloride material itself effects a smooth surface for effecting easy relative sliding movements, and undesired frictional resistance is further reduced by virtue of the line contact engagement provided by ribs 20 without impairing the effectiveness of the seal maintaining the shape of the strip.

Figure 4:
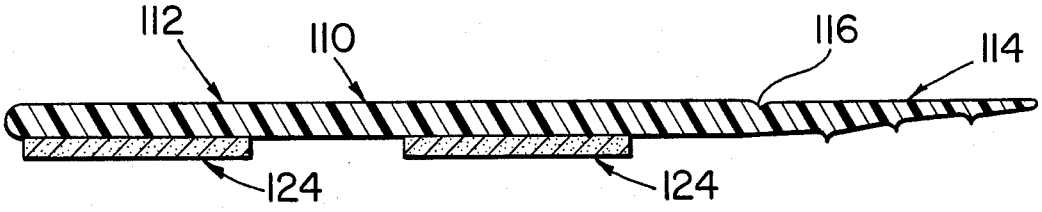
FIG. 4 is a cross-sectional view of another embodiment of a weather strip incorporating this invention.

As shown in FIG. 4, the strip 110 of this invention may be made in a variety of sizes, and modifications may be introduced within the scope of the contemplated invention. FIG. 4 more specifically illustrates a body 112 of greater thickness than that shown in the strip 10 of FIGS. 1–3, and the body 112 is of increased rigidity for use in heavy duty applications such as on garage doors and the like. Two separate double-faced adhesive tape strips 124, 124 are shown secured in parallel relation to one another and will be understood to extend longitudinally of the body 112 and its side edge extension 114 which is formed in integral generally coplanar relation to the body 112. As in the embodiment of FIGS. 1–3, the engagement between the deflectable extension 114 and a surface (not shown) engaged thereby may be varied to a limited extent depending on the location of edge 116 of the attachment body 112 relative to the joint to be sealed, thereby providing a seal which may be varied somewhat from application to application from primarily a tip seal to a seal of increased surface-to-surface contact engagement.

Based on the foregoing disclosure, it will be seen that the semi-rigid body provides a desired rigidity for the mounting of the foam tape and to maintain its integrity throughout the stages of packaging and installation without compromising the final quality of the seal. The foam tape not only functions to fix the strip but additionally provides a cushioning effect for enhancing the effectiveness of the seal provided by the body over irregular surfaces. The disclosed precisely tapered extension coacts with the body in providing a significant sealing force adjacent their juncture precisely where it is required at the joint between the surfaces to be sealed. The ribbed extension surface provides resistance to undesired deformation perpendicular to the flex axis and, in addition to increased structural strength, the ribs minimize sliding frictional resistance over the variety of the surfaces to which the aesthetically pleasing weather strip of this invention may be applied.

As will be apparent to persons skilled in the art, various modifications, adaptations and variations of the foregoing specific disclosure can be made without departing from the teachings of this invention.

I claim

1. A resilient plastic weather strip comprising a semi-rigid, elongated flat attachment body and a relatively flexible extension, the flexible extension being formed in integral relation to the flat attachment body along one side edge thereof and defining a juncture between the flat attachment body and its flexible extension, the juncture defining a longitudinally extending flex axis, the flexible extension being deflectable about said longitudinally extending flex axis between a relaxed nonsealing position and a deflected sealing position, the flexible extension being tapered from said juncture to a free terminal edge and providing a variable pliancy which gradually increases in flexibility laterally across the flexible extension toward said free terminal edge, the flexible extension in its relaxed nonsealing position having one surface extending in its entirety in generally coplanar relation to a corresponding surface of the flat attachment body, the flexible extension in its deflected sealing position assuming a substantially planar condition diverging at an angle relative to the flat attachment body, the flexible extension having a plurality of longitudinally extending ribs formed on a sealing surface of the flexible extension in parallel relation to said longitudinally extending flex axis.

2. The strip of claim 1 wherein a double-faced adhesive foam tape is secured to and extends longitudinally along one surface of the flat attachment body, wherein the flexible extension is of reduced width relative to the width of the flat attachment body, wherein the strip is of uniform cross-section throughout its length, and wherein the flat attachment body and its flexible extension are formed of co-extruded polyvinyl chloride.

3. In combination, a resilient plastic weather strip comprising a semi-rigid, elongated flat attachment body and a relatively flexible extension, the flexible extension being formed in integral relation to the flat attachment body along one side edge thereof and defining a juncture between the flat attachment body and its flexible extension, the juncture defining a longitudinally extending flex axis, the flexible extension being deflectable about said longitudinally extending flex axis between a relaxed nonsealing position and a deflected sealing position, the flexible extension being generally uniformly tapered from said juncture to a free terminal edge and providing a variable pliancy which gradually increases in flexibility laterally across the flexible extension toward said free terminal edge, a fixed frame, and a closure for the frame, the flat attachment body being secured to one of the frame and closure members in adjacent parallel relation to a longitudinally extending joint therebetween, the flexible extension in its relaxed nonsealing position having one surface extending in its entirety in generally coplanar relation to a corresponding surface of the flat attachment body, the flexible extension having a sealing surface engageable with the other of the frame and closure members, the flexible extension being deflected about said longitudinally extending flex axis, upon engagement with said other of the frame and closure members, into said deflected sealing position relative to said longitudinally extending joint when the closure is moved into a closed position, the flexible extension in its deflected sealing position assuming a substantially planar condition in engagement with said other of the frame and closure members and diverging at an angle relative to the flat attachment body, the flexible extension having a plurality of longitudinally extending ribs formed on said sealing surface of the flexible extension in parallel relation to said longitudinally extending flex axis.

4. The strip of claim 3 wherein a double-faced adhesive foam tape is secured to and extends longitudinally along one surface of the flat attachment body, wherein the flexible extension is of reduced width relative to the width of the flat attachment body, wherein the strip is of uniform cross-section throughout its length, and wherein the flat attachment body and its flexible extension are formed of co-extruded polyvinyl chloride.

* * * * *